US006286484B1

(12) United States Patent
Niethammer et al.

(10) Patent No.: US 6,286,484 B1
(45) Date of Patent: Sep. 11, 2001

(54) FUEL INJECTION DEVICE FOR INTERNAL COMBUSTION ENGINES

(75) Inventors: Bernd Niethammer, Nürtingen; Steffen Martin, Niederfrohna; Martin Lenk, Chemnitz, all of (DE)

(73) Assignee: Hydraulik-Ring GmbH (DE)

( * ) Notice: Subject to any disclaimer, the term of this patent is extended or adjusted under 35 U.S.C. 154(b) by 0 days.

(21) Appl. No.: 09/425,853

(22) Filed: Oct. 22, 1999

(30) Foreign Application Priority Data

Oct. 30, 1998 (DE) ..... 198 50 016

(51) Int. Cl.[7] ..... F02M 33/04
(52) U.S. Cl. ..... 123/447; 123/467
(58) Field of Search ..... 123/510, 511, 123/457, 467, 447

(56) References Cited

U.S. PATENT DOCUMENTS 4,167,168 * 9/1979 Yamamoto ..... 123/467
4,711,209 * 12/1987 Henkel ..... 123/467
5,029,568 * 7/1991 Perr ..... 123/447
5,076,236 * 12/1991 Yu et al. ..... 123/467
5,195,487 * 3/1993 Zurner et al. ..... 123/447
5,718,385 * 2/1998 Fontell ..... 123/467

* cited by examiner

*Primary Examiner*—Thomas N. Moulis
(74) *Attorney, Agent, or Firm*—Robert W Becker & Associates; Robert W. Becker

(57) ABSTRACT

The present invention relates to a fuel injection device for combustion engines, preferably Diesel engines, with at least one pilot valve by means of which a control piston is displaceable by a pressure medium in order to convey fuel through at least one line/channel toward a combustion chamber of the internal combustion engine, whereby at least one accumulator is provided in the flow path of the fuel or the pressure medium, and an accumulator space is connected to the connecting line/channel for the fuel or the pressure medium.

15 Claims, 2 Drawing Sheets

FUEL INJECTION DEVICE FOR INTERNAL COMBUSTION ENGINES

BACKGROUND OF THE INVENTION

The present invention relates to a fuel injection device for combustion engines, preferably Diesel engines, with at least one pilot valve by means of which a control piston is displaceable by a pressure medium in order to convey fuel through at least one line/channel toward a combustion chamber of the internal combustion engine.

For a reliable and clean mixture formation, internal combustion engines, Diesel engines in particular, require an injection process consisting of several individual injection actions. The injection processes are divided into pre-injection and main injection of the fuel quantity. FIG. 3 illustrates the injection process. First, triggered by a switching pulse of the engine control, a pilot or pre-injection occurs. After a time period t, the pilot or pre-injection is terminated by a cut-off pulse and after a time period t, the main injection of the fuel is started by a switching pulse. The main injection has a longer duration than the pre-injection stage. Also, significantly more fuel is injected during the main injection than during the pre-injection stage. Particularly for producing the pre-injection quantity, a control unit is employed which, however, requires a high-cost electronic control system and which shows energetic losses. Frequently, a damper is employed for producing the pre-injection fuel quantity. This damper, however, cannot be fully utilized in each step of the operation. The reason for this is that the response times of the control hydraulic are too long in the event of small injection quantities due to the design of the control elements and a small pre-injection quantity can, therefore, be produced only with the help of a significant control-technical structural design and expenditure.

Therefore, it is an object of the present invention to provide a fuel injection device of the aforementioned kind such that a small pre-injection quantity can be produced with the fuel injection device having a simple structural design and only requiring a small control-technical expenditure and design.

SUMMARY OF THE INVENTION

This object is solved by the inventive fuel injection device by providing at least one accumulator in the flow path of the fuel or the pressure medium and connecting the accumulator space of the at least one accumulator with the connecting line for the fuel or the pressure medium.

With the inventive fuel injection device, the quantity of the fuel to be conveyed is, in addition to a minimum activation time of the control valve, minimized by the accumulator. A portion of the fuel to be conveyed to the combustion chamber or a portion of the pressure medium enters the accumulator. The accumulator volume for fuel or pressure medium is instantly available during a pre-injection action. When fuel is conveyed to the accumulator, only a minimum quantity of fuel needs to be conveyed to the combustion chamber via the connecting line. It is sufficient if the accumulator volume is smaller than the minimum quantity of fuel to be conveyed during the pre-injection stage. Therefore, only such a quantity of fuel needs to be conveyed to the combustion chamber during the pre-injection stage by the control piston which quantity equals the difference between the fuel amount that can be removed from the accumulator and the required pre-injection quantity. The accumulator can also be arranged such that it receives a portion of the pressure medium which acts upon the control piston. Also in this manner, the injection quantity of fuel can be limited. The accumulator volume can be selected to be equal to, larger or smaller than the minimum fuel volume to be conveyed during the pre-injection stage. If the accumulator volume is larger, any quantity of fuel can be conveyed. The accumulator does not require a high-cost electronic control system and no costly designed control elements. Therefore, even the smallest injection quantities can be reliably produced with the inventive injection device with a simple structural design and at lowest control-technical design and expenditure.

The accumulator can be provided within the inventive injection device, however, it can also be provided externally of the injection device. The accumulator volume can be designed to be fixed, however, it can also be designed to be variable. The accumulator makes a volume variation possible which results, depending on the respective adjustment of the accumulator, in a reduced quantity of fuel exiting when a hydraulic intake volume of fuel is predetermined time-wise.

BRIEF DESCRIPTION OF THE DRAWINGS

The object and advantages of the present invention will appear more clearly from the following specification in conjunction with the accompanying schematic drawings in which.

DESCRIPTION OF PREFERRED EMBODIMENTS

Figure 1:
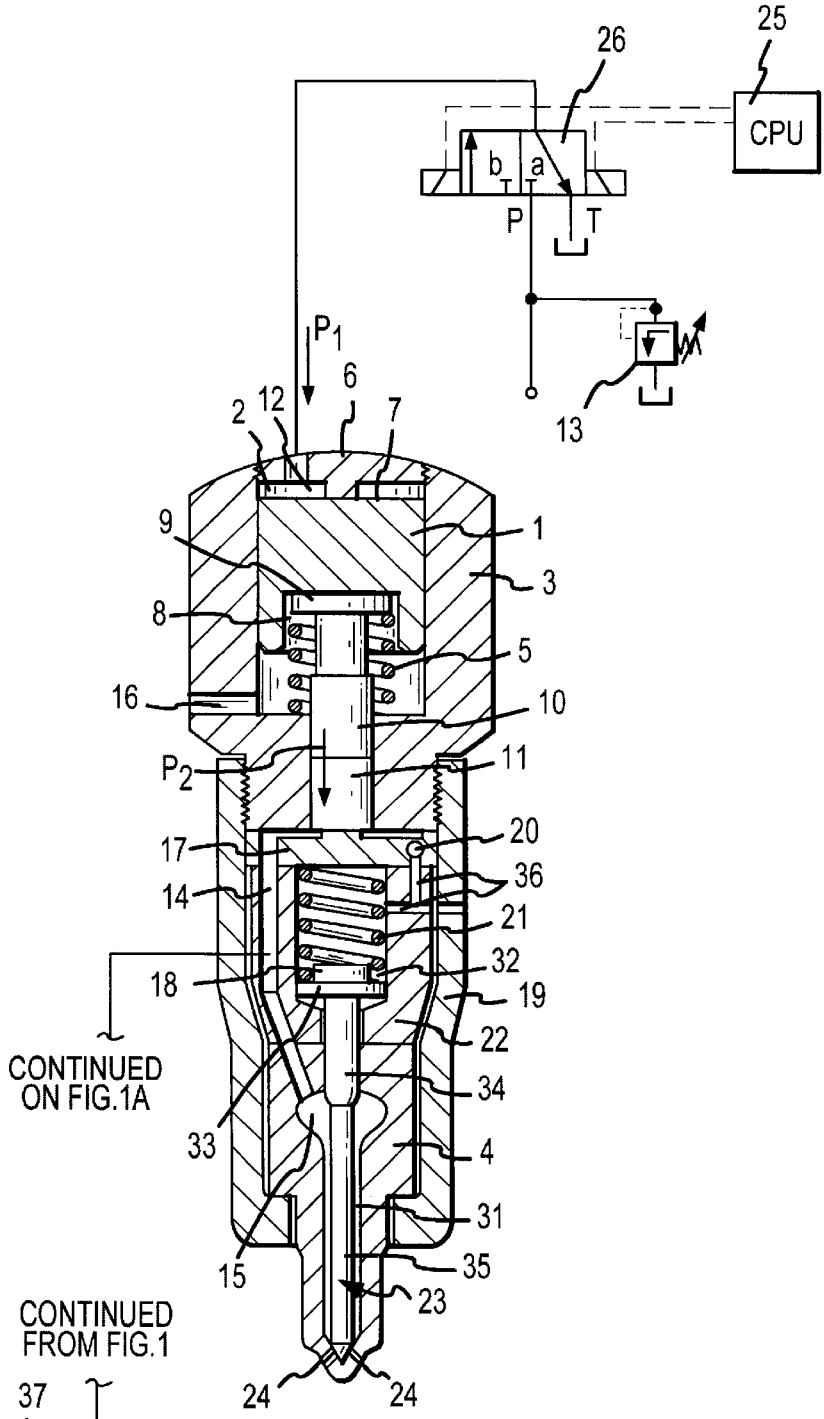
FIG. 1 shows a longitudinal section of an inventive injection-quantity limiting device.
Figure 1A:
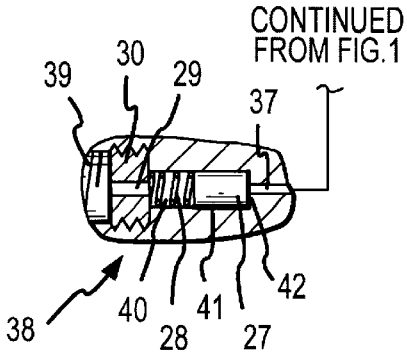
FIG. 1A is a detailed view of the accumulator within the insertion members.

The present invention will now be described in detail with the aid of several specific embodiments utilizing FIGS. 1 through 3.

The injection quantity limiting device is a part of an injection device with a pressure regulator with the aid of which an injection valve 4 of internal combustion engines, Diesel engines in particular, is activated. The pressure regulator has a control piston 1 which is displaceable within a channel/bore 2 of a housing member 3. When the injection valve 4 is closed (FIG. 1), the control piston 1 abuts a stop 6 under the force of a spring 5. The stop 6 can be adjustable, e.g., embodied as a screw member or as an insertable socket member. It is also possible to provide as a stop 6 a retaining ring which is inserted in the wall of the bore 2. FIG. 1 shows the control piston 1 in a starting position, displaced by the force of the spring 5. In this starting position, a needle-shaped valve body 23 of the injection valve 4 closes off nozzle openings 24. Fuel is fed via the nozzle openings 24 to the combustion chamber of the internal combustion engine.

The control piston 1 has a piston surface 7 which is acted upon by system pressure $p_1$. At its opposite end, the control piston 1 is provided with a recess 8 the bottom surface 9 of which is abutted by a pressure transferring or intensifying piston 10. It has a smaller diameter than the control piston 1 and projects into a second bore 11 of the housing means 3. The second bore 11 has a smaller diameter than the bore 2. The pressure $p_1$ is intensified by the pressure intensifying piston 10 creating the larger pressure $p_2$ which acts upon the injection valve 4.

The hydraulic medium acting upon the piston surface 7 is fed by a channel/pressure line 12 to which a pilot valve 26 is connected which can also be embodied as a piezo valve. The pilot valve 26 is connected to a pressure supply which is controlled by a control valve 13 by means of which the initial pressure is adjusted. The pilot valve 26 and the control valve 13 can be controlled directly or indirectly by means of the engine control. The pilot valve 26 is connected to a control unit 25 which controls and monitors the operation of the pilot valve 26 and the control valve 13 and which is connected to the engine control. In the starting position of the control piston 1 illustrated in FIG. 1, the bore 2 is relieved to the tank T via the pressure line 12 and the pilot valve 26.

When the internal combustion engine is operated, the pilot valve 26, controlled by the control unit 25, is switched such that the hydraulic medium is pressurized. The hydraulic medium reaches the piston surface 7 via the pressure line 12. Thus, the system pressure $p_1$ acts upon the piston surface 7. The recess 8 opposite the piston surface 7 is relieved of pressure and is connected to the atmosphere by a bore opening 16 penetrating the housing member 3. The air within the recess 8 and within the space containing the spring is displaced through the bore opening 16. The control piston 1 is displaced against the force of the spring 5 by the system pressure $p_1$. Thereby, the pressure intensifying piston 10 is also displaced whereby the fuel within the second bore 11 is pressed into a channel 14 by a fixedly connected distribution plate 17. The channel 14 is provided within an insertion member 22 which is received by a threaded socket member 19. The threaded socket member 19 is screwed onto the housing member 3 and receives the injection valve 4 which projects out of the threaded socket member 19. The distribution plate 17 is clamped by means of the threaded socket member 19 between the insertion member 22 and the housing member 3. The channel 14 extends from the distribution plate 17 through the insertion member 22 and the injection valve 4 to an injection chamber 15 which is penetrated by the valve body 23. An axial bore 31 is provided, adjoining the injection chamber 15 and leading to the nozzle openings 24 and it has a larger diameter than the portion of the valve body 23 which projects into the axial bore 31. The valve body 23 projects into a central receiving cavity 32 of the insertion member 22. The central receiving cavity 32 is closed off at the opposite side by the distribution plate 17. One end of a compression spring 21 is supported on the distribution plate 17 and its other end rests on a shoulder member 33. The shoulder member 33 is provided at the end portion of the valve body 23 that is positioned within the central receiving cavity 32 and has a central projection 18 for centering the compression spring 21. The valve body 23 projects with an enlarged portion 34 into the injection chamber 15. Within the injection chamber 15 the enlarged portion 34 merges into a thinner end portion 35.

Pressure is exerted upon the enlarged portion 34 of the valve body 23 by the fuel entering the injection chamber 15, and the valve body 23 is thereby pushed back against the force of the compression spring 21. The nozzle openings 24 are thus released so that the fuel can enter the combustion chamber.

Subsequent to this injection process, the pilot valve 26 is switched by the control unit 25 so that the pressure line 12 is released to the tank T via the pilot valve 26. The control piston 1 is, therefore, via the pressure intensifying piston 10, pushed back to the stop 6 by the force of the spring 5. Furthermore, the valve body 23 is pushed back by the compression spring 21 to the closing position illustrated in FIG. 1. Subsequently, a new injection cycle is started in the manner described.

Via a back pressure valve 20 provided within the distribution plate 17, fuel is taken in from a fuel container (not illustrated) during the return stroke of the pistons 1, 10 through an opening 36 within the threaded socket member 19 and within the insertion member 22. The fuel reaches the second bore 11 via the distribution plate 17 so that it can be conveyed to the nozzle openings 24 during the next stroke of the pressure intensifying piston 10 in the manner described. The opening 36 also opens into the central receiving cavity 32. During the return stroke of the pressure intensifying piston 10 the back pressure valve 20 is opened up by the low pressure that is created whereby fuel is taken in.

The channel 14 is connected to an accumulator 38 within the insertion member 22 via a lateral bore 37 within the insertion member 22. In the illustrated embodiment, the accumulator 38 is formed by an accumulator piston 27 and an accumulator compression spring 28 which is supported on an adjusting screw 30. It is screwed into a threaded bore 39 within the insertion member 22. The force ofthe accumulator compression spring 28 can be continuously adjusted by the adjusting screw 30. The adjusting screw 30 has a central screw bore 29 penetrating the adjusting screw 30. The space 40 receiving the accumulator compression spring 28 is connected to the atmosphere via the central screw bore 29. The accumulator piston 27 is positioned to be sealed off within a piston space 41 into which the lateral bore 37 opens up.

FIG. 1 shows the starting position of the accumulator piston 27 which abuts the bottom surface 42 of the piston space 41 under the force of the accumulator compression spring 28.

The accumulator 38 has the effect that the quantity of fuel to be conveyed is minimized in addition to a minimum activation time of the pilot valve 26. When the pilot valve 26 is switched by the control unit 25 in the manner described, from its starting position illustrated in FIG. 1, the control piston 1 is displaced in the manner described whereby the higher pressure $p_2$ acting upon the fuel to be conveyed is created by the pressure intensifying piston 10. Since the activation time of the pilot valve 26 cannot be reduced any further, an excessive amount of fuel is conveyed into the accumulator 38 via the lateral bore 37. The pressure $p_2$ is larger than the pressure exerted upon the accumulator piston 27 by the accumulator compression spring 28 so that the accumulator piston 27 is pushed backward by the excessive fuel amount, against the force of the accumulator compression spring 28. Thereby, the excessive fuel amount can be received by the piston space 41. The air within the space 40 is displaced to the atmosphere via the central screw bore 29. The conveying duration for the accumulator volume is kept available for the entire conveying duration of the fuel. Therefore, any accumulator volume can be varied by a longer control signal, and, thus, a longer opening duration of the nozzle openings 24.

Figure 2:
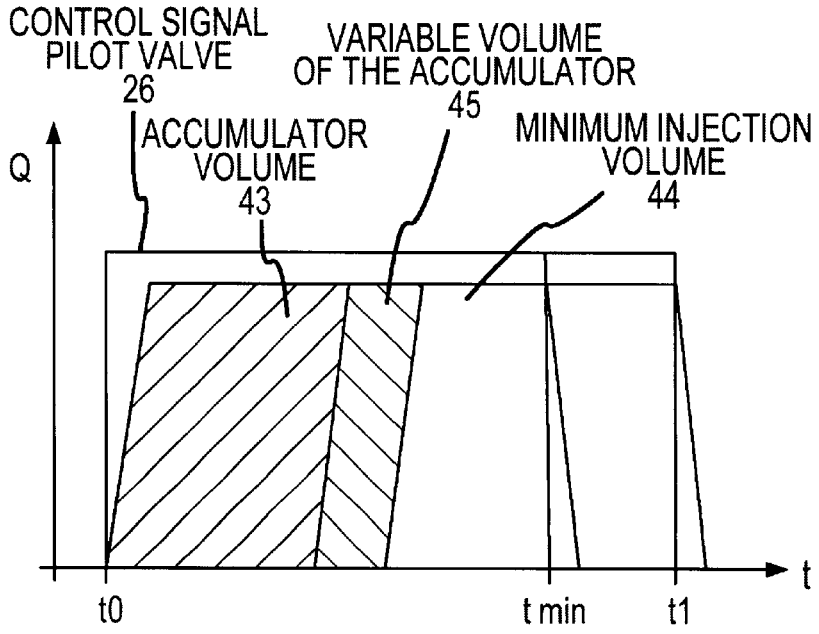
FIG. 2 shows a diagram of the time sequence of an injection process in which the inventive injection quantity limiting device is used.
Figure 3:
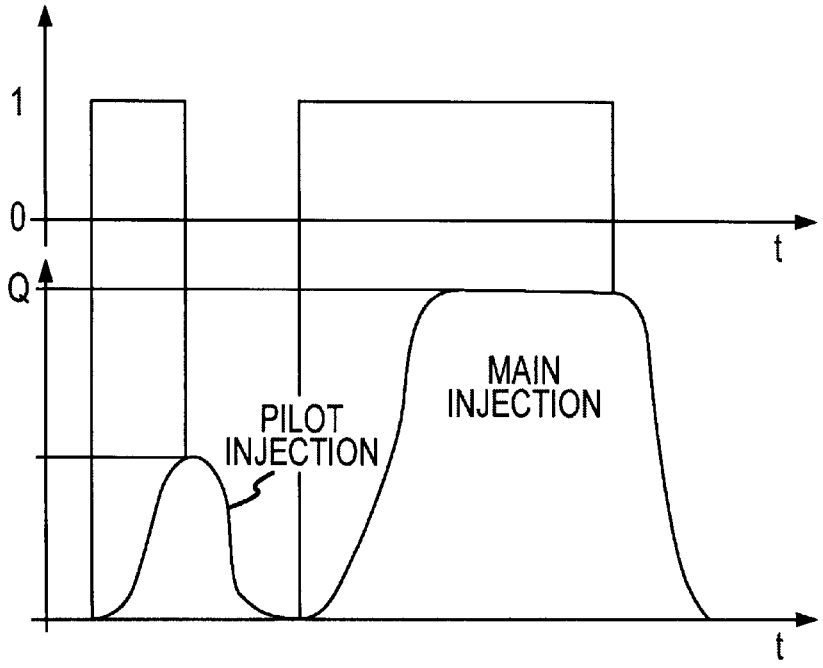
FIG. 3 shows a flow quantity/time diagram of an injection process.

As can be seen from FIG. 2, the pilot valve 26 is controlled at the time $t_0$. Thereby, the pressure intensifying piston 10 is displaced by the control piston 1 in the manner described. The pressure intensifying piston 10 presses the fuel within the second bore 11 via the distribution plate 17 into the channel 14. A portion of this fuel quantity reaches the accumulator 38 via the lateral bore 37. This accumulator volume is designated the reference numeral 43 in FIG. 2. The minimum fuel injection volume 44 is reached at the time $t_{min}$. Subsequent to the time $t_1$, the pilot valve 26 is again activated whereby the injection process is terminated in the manner described. Accordingly, the injection quantity Q decreases to zero after a certain time delay. By employing the accumulator 38, the injection quantity is limited in a structurally simple manner. If the accumulator volume is selected to be larger than the minimum volume 44 conveyed, any volume can be conveyed, starting at 0 $mm^3$. When the force of the accumulator compression spring 28 is selected to be larger than the opening force of the valve body 23, a reduced fuel volume can be injected into the combustion chamber until the accumulator 38 is entirely filled.

When the pilot valve 26 is positioned in the closing position according to FIG. 1, the fuel quantity within the piston space 41 is reconveyed into the channel 14 by the accumulator piston 27 via the lateral bore 37 because the accumulator piston 27 is displaced by the accumulator compression spring 28 into its starting position illustrated in FIG. 1. However, as soon as the injection process is again started by switching the pilot valve 26, a portion of the fuel acted upon by the pressure $p_2$ within the channel 14 is conveyed into the piston space 41 via the lateral bore 37 whereby the accumulator piston 27 is pushed back accordingly against the force of the accumulator compression spring 28.

FIG. 2 illustrates that the volume of the accumulator 38 can vary by the amount 45. Depending on the magnitude of the pressure $p_2$ within the channel 14, a larger or a smaller amount of fuel is conveyed into the accumulator 38. The force of the accumulator compression spring 28 can be optimally adjusted by the adjusting screw 30 to the respective requirement. Corresponding to the spring force, the accumulator piston 27 is pushed back within the piston space 41 to a variable extent depending on the pressure $p_2$ within th channel 14. The fuel quantity which can be received by the accumulator 38 can thereby be varied. By employing the accumulator 38, the fuel volume to be conveyed can be minimized when the pilot valve 26 has a minimum activation time. A structurally complicated control unit is not required for achieving this result. By employing the accumulator 38, a very small quantity of fuel can, thus, be injected into the combustion chamber. Thereby, particularly the pre-injection followed by a main injection of fuel can be carried out inexpensively. The accumulator 38 itself can have any suitable structural design. It does not have to comprise the accumulator piston 27 and the accumulator compression spring 28. For example, it is possible without difficulty to form the accumulator by a membrane and a bubble accumulator.

The accumulator 38 can also be connected to the bore 2 or the pressure line 12. In that case, the accumulator 38 does not receive fuel, but a hydraulic medium. Also in that case, a limitation of the injection quantity of fuel can be achieved. Receiving a portion of the hydraulic medium for acting upon the control piston 1 by the accumulator has the same effect as receiving a portion of the fuel.

Finally, it is possible to vary the pre-compression force of the accumulator compression spring 28 by the control unit 25. For example, a spindle can be provided at which the adjusting screw is positioned and which is turned as a function of signals of the control unit 25. The adjusting screw 30 is shifted as a function of the turning direction of the spindle and thus, the pre-compression force of the accumulator compression spring 28 is altered.

The specification incorporates by reference the disclosure of German priority document 198 50 016.5 of Mar. 3, 1999.

The present invention is, of course, in no way restricted to the specific disclosure of the specification and drawings, but also encompasses any modifications within the scope of the appended claims.

What is claimed is:

1. A fuel injection device for internal combustion engines comprising:

a housing means having at least one channel forfuel or pressure medium;

a control piston provided within said housing means;

at least one pilot valve, whereby said pilot valve displaces said control piston by means of a pressure medium for conveying fuel via said at least one channel in the direction of an injection chamber of said internal combustion engine, whereby said control piston places said fuel or said pressure medium under pressure; and a valve body adjustable between an open and closed position and projecting through said injection chamber, said valve body closing nozzle openings leading to a combustion chamber of said internal combustion engine when said injection chamber is filled with said fuel or said pressure medium, whereby said valve body is pressurized by a pressure causing said valve body to remain in said closed position and, wherein said fuel or said pressure medium is pressurized by a second pressure that is greater than the pressure under which said valve body remains in said closed position, and wherein said valve body is adjustable into the open position under pressure of the fuel or pressure medium, thereby opening said nozzle openings.

2. A fuel injection device according to claim 1, further comprising at least one accumulator for said fuel or said pressure medium disposed in a flow direction of said fuel or said pressure medium, wherein said at least one accumulator is provided with an accumulator space which is connected to said at least one channel for said fuel or said pressure medium.

3. A fuel injection device according to claim 2, wherein said at least one accumulator is provided with an accumulator volume, and which includes means for biasing said accumulator volume.

4. A fuel injection device according to claim 3, wherein said accumulator volume within said accumulator space is pressurized by a pressure that is smaller than a pressure with which said fuel is conveyed to said combustion chamber.

5. A fuel injection device according to claim 3, which includes means for adjusting a pressure acting on said accumulator volume.

6. A fuel injection device according to claim 3, wherein said accumulator volume is equal to, larger, or smaller than a minimum fuel quantity to be conveyed to said combustion chamber.

7. A fuel injection device according to claim 2, wherein said at least one accumulator is connected to said at least one channel by a lateral bore.

8. A fuel injection device according to claim 2, wherein said at least one accumulator is provided within said injection device.

9. A fuel injection device according to claim 2, wherein said at least one accumulator is provided externally of said injection device.

10. A fuel injection device according to claim 2, wherein said accumulator space is delimited by an accumulator piston.

11. A fuel injection device according to claim 10, wherein said accumulator piston is acted upon by a force of at least one compression spring.

12. A fuel injection device according to claim 11, wherein said at least one compression spring is supported on an adjusting member, preferably an adjusting screw.

13. A fuel injection device according to claim 12, wherein said adjusting member is provided with at least one bore by which a space receiving said compression spring is vented to the outside.

14. A fuel injection device according to claim 2, wherein said pilot valve is a switch valve.

15. A fuel injection device according to claim 2, wherein said pilot valve is a piezo valve.

* * * * *